United States Patent [19]

Riggs

[11] Patent Number: 4,504,454

[45] Date of Patent: Mar. 12, 1985

[54] PROCESS OF SPINNING PITCH-BASED CARBON FIBERS

[75] Inventor: Dennis M. Riggs, Simpsonville, S.C.

[73] Assignee: E. I. Du Pont de Nemours and Company, Wilmington, Del.

[21] Appl. No.: 479,415

[22] Filed: Mar. 28, 1983

[51] Int. Cl.[3] ..... D01F 9/12

[52] U.S. Cl. ..... 423/447.1; 423/447.2; 423/447.4; 423/447.6; 423/447.8; 423/448; 264/29.2; 264/108; 264/176 F

[58] Field of Search ..... 423/447.1, 447.2, 447.4, 423/447.6, 447.7, 447.8, 448; 264/29.2, 108, 176 F; 428/367

[56] References Cited

U.S. PATENT DOCUMENTS 3,991,170 11/1976 Singer ..... 208/22

4,331,620 5/1982 Diefendorf et al. ..... 423/447.4

4,351,816 9/1982 Schulz ..... 264/29.2

4,376,747 3/1983 Nazem ..... 264/176 F

FOREIGN PATENT DOCUMENTS 1308536 2/1973 United Kingdom ..... 423/447.8

*Primary Examiner*—John Doll

*Assistant Examiner*—Steven Capella

[57] ABSTRACT

This invention features an improved spinning process for pitch-based carbon fibers, that will provide a continuous pitch-based carbon fiber having a uniform pattern of graphite crystallites over a substantial portion of the fiber cross-section and/or aligned along the fiber axis in the form of undulating ribbons. Continuous carbon fibers having the preferred orientation of graphite crystallites will exhibit greater mechanical properties.

16 Claims, 15 Drawing Figures

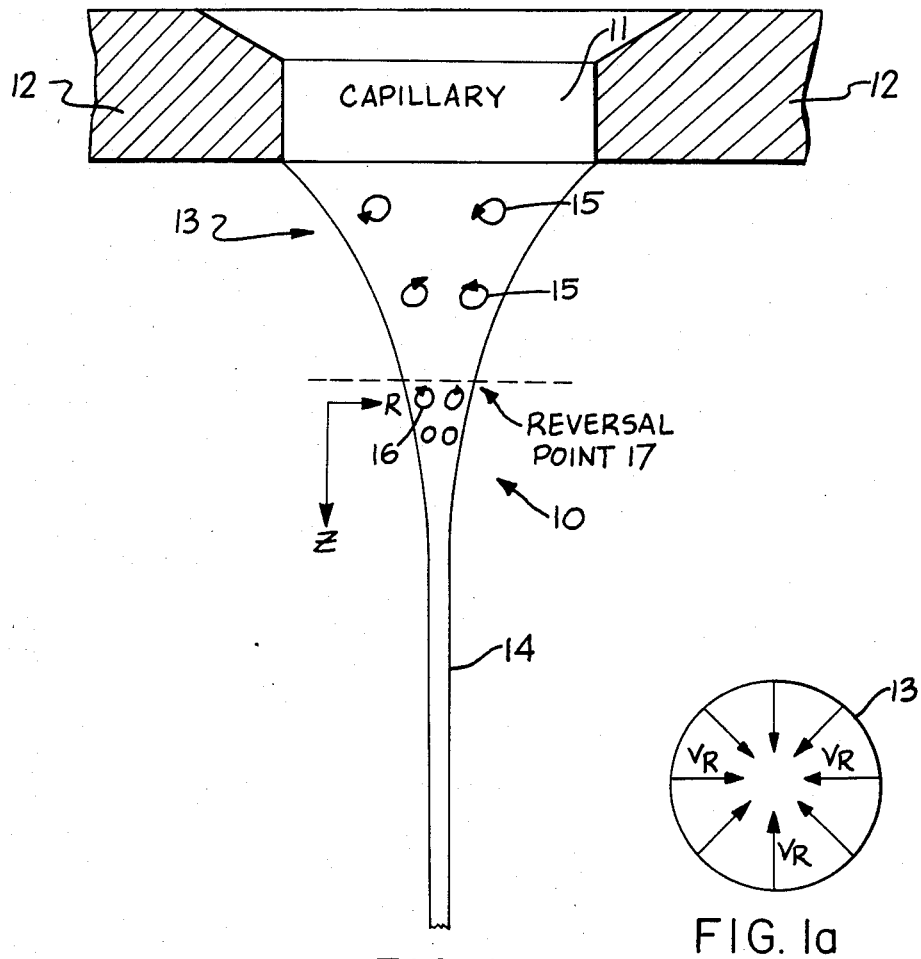
FIG. 1
FIG. 1a
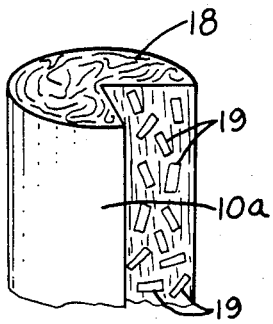
RANDOM
PRIOR ART
FIG. 2a
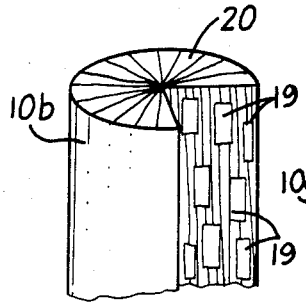
RADIAL
FIG. 2b
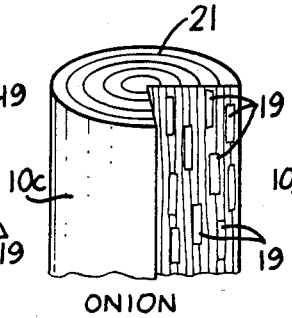
ONION SKIN
FIG. 2c
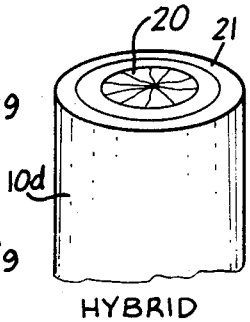
HYBRID
FIG. 2d

PROCESS OF SPINNING PITCH-BASED CARBON FIBERS

FIELD OF THE INVENTION

The invention relates to the manufacture of continuous pitch-based carbon fibers and more particularly to an improved spinning technique for providing a continuous pitch-based carbon fiber having superior mechanical properties.

BACKGROUND OF THE INVENTION

Heretofore, there have been two distinct approaches for achieving high strength pitch-based carbon fibers. One of these approaches features a method of perfecting the chemistry of the pitch precursor, so that the pitch introduced to the spinning process will be highly anisotropic and free from strength-robbing ash and impurities. The theory being that the ultimate product integrity is most dependent upon the chemistry of the precursor. Another approach has been to formulate and process a pitch which would provide the best characteristics for spinning. The theory is that the final product is most influenced by the spinning procedure independent of whether the precursor contains the optimum chemistries.

The present invention is concerned with the latter approach for achieving high strength fibers. While it is realized that it is important to process a pitch precursor to obtain the proper chemistries, the present invention emphasizes the need to focus upon obtaining a precursor having the optimum rheological characteristics required to achieve optimum spinning conditions.

In recent times, there has been much confusion as to the necessary spinning parameters and the rheology of the carbon fiber precursor needed to produce high strength fibers.

It was originally believed that an ordered texture should be produced in the spun pitch in order to align the domains or fibrils such that upon subsequent oxidation and carbonization, these fibrils would link together to form continuous graphite crystallites. The formation of continuous graphite crystallites were believed to be necessary in order to provide the high tensile and mechanical strengths in the fiber. Therefore, the initial wisdom was to provide a spun pitch having a radial texture throughout its cross-section.

It was not long before it was noticed that spun pitch havng a radial cross-section tended to split along the fiber axis, and the high strengths that were theoretically possible were never realized.

More recently, it has been discovered that spun fibers having a random cross-section produce carbon fibers with greater mechanical properties and strengths than the previous radially textured fibers. These fibers do not exhibit the tendency to split along the fiber axis as the previous radially textured fibers.

In order to achieve a random texture in the spun fiber, current carbon precursors are produced having a low glass transition temperature and a low viscosity.

It has not been known in the past, however, what rheology or spin parameters would provide the best results.

The present invention is based upon a mathematical model, which was developed to study the structural changes in the fiber as it is being spun. It was theorized that if one could understand the forces shaping the domains, textures and fibrils during spinning, one would be able to make a better determination of the necessary spinning parameters and rheology needed to effect a strong fiber. The mathematical model was followed by a series of tests designed to affirm or deny the results of the study.

While the complete picture is still not thoroughly understood, the results of the present research have been most illuminating if not actually startling.

It has been discovered that when a precursor is spun and drawn from the counterbored capillaries of the spinnerette, it is acted upon by radial forces tending to influence the shaping of the domains into a radially textured cross-section.

This texture, however, will only be maintained in the final product if the spinning "carrot" of the fiber has a given viscosity as it is being spun and drawn. Changes in the "carrot" viscosity can produce textures in the fiber of all kinds, including: onion skin, radial, random or a hybrid of two or more of the above.

Furthermore, it is theorized that as the viscosity of the "carrot" is varied, the longitudinal alignment of the fibrils will be greatly influenced.

It is noted that a radial texture may form at a particular viscosity of the precursor, wherein the alignment of the fibrils along the longitudinal axis is nearly parallel.

At a higher viscosity, it has been discovered that a radial texture may be formed wherein the alignment of the fibrils along the longitudinal axis is skewed tending to form undulating ribbons in the final fiber product.

According to Reynolds-Sharp theory, the orientation of the mesophase fibrils and the subsequent orientation of the graphite crystallites resulting therefrom after carbonization, should not be parallel or so near parallel, that the fiber becomes susceptible to cracking from internal defects. Expressed in another way, parallel aligned carbon crystallites are more subject to damage from internal defects. These defects are always present in every precursor, and they cannot be eliminated. Therefore, a parallel or near parallel alignment, according to theory should result in a more flaw sensitive fiber and hence, should be avoided.

Our tests have shown that the cracking and splitting of the fibers occurs when alignment of the crystallites tends to parallel the longitudinal axis of the fiber. In other words, the test results appear to conform with theory.

It has been further discovered that as the viscosity of the spinning "carrot" of the fiber is changed, both the texture and the alignment of the fibrils will change, such that it is possible to pass through a spectrum of different textures and alignments. These different spin results appear at present to fall within four distinct zones. In a first zone wheerin a precursor has very low spin viscosities, a fiber with a random texture and crystallites with a high degree of alignment is developed. As the viscosity is increased, a second zone develops wherein a radial textured fiber is formed having crystallites with a lesser degree of alignment.

A third zone is achieved at still higher viscosities wherein the texture becomes random and the alignment of the crystallites become more skewed. A final or fourth zone features a radially textured fiber having crystallites with a highly skewed alignment producing undulating ribbons.

It is believed at this time, that the best precursors are ones that will have a cross-section with an ordered (typically radial) texture and crystallites having a highly skewed alignment with respect to the longitudinal axis such that undulating ribbons are formed in the final fiber product.

It has been discovered that the aforementioned zones are a result of a "spin reversal" in the "carrot" of the spinning pitch. The loss of vorticity and the viscosity at the spin reversal are the two factors which most probably do more to change the texture and alignment characteristics of the fiber than any other factor.

Till now, no one to the best of our knowledge and belief, has realized that such a reversal exists in the spinning "carrot".

At very low viscosities, the vortices in the "carrot" may not form, or may be so weak, that a random texture will form, i.e. the vorticity does not shape the orientation of the fibers. This condition corresponds to zone one, as mentioned above.

As the viscosity increases poorer orientations will be frozen into the surface of the fiber more rapidly and in addition, the spin reversal will act to reorientate the initial radial texture into a second radial texture, i.e. a second zone condition is observed.

When the viscosity of the precursor increases even more, the texture cannot be reformed below the spin reversal thus giving a randomly textured cross-section (zone three).

At sufficiently high enough viscosity, the texture will not be lost at the "spin reversal" and hence, the fiber will maintain its initial radial texture (zone four).

Thus, there is a zone on either end of the viscosity spectrum (zones one and four), which is not influenced by loss of vorticity at the spin reversal. Hence, this zone will provide a preferred fiber texture. At the high viscosity end (zone four), the skewed alignment is such that undulating ribbons in the fiber will result. Thus, the present invention seeks to increase rather than decrease the viscosity of the precursor in order to obtain an optimum rheological condition.

BRIEF DISCUSSION OF RELATED ART

As aforementioned, conventional wisdom teaches increasing the temperature and decreasing the viscosity of the pitch material in order to facilitate the spinning of the pitch into fiber. The result of this technique would most often produce a fiber having a random texture throughout its cross-section. A recent patent illustrating such a process can be seen in Great Britain Pat. No. 2,095,222; assigned to Kureha. This patent teaches using a very low viscosity, very high temperature pitch for spinning a fiber having a random structure throughout its cross-section.

By contrast, the present invention teaches an opposite proposition, i.e. decreasing the spinning temperature and increasing the viscosity of the pitch material. By controlling these spinning parameters, it is possible to influence the shear and vorticities in the spinning thread, thus resulting in a continuous fiber that is substantially free of randomized textures and which has undulating ribbons of graphite crystallites with respect to the fiber axis.

Other factors and parameters may be controlled to achieve ordered texture in the fiber. Such parameters will be discussed in the subsequent detailed description of this invention. The inventive scope, purview or purpose of the invention is not to be interpreted as limited to any particular spin parameter or its control.

To the best of our knowledge and belief, the invention teaches for the first time a true understanding of how to consistently produce high strength continuous pitch-based fibers. The control of the spinning parameters of the pitch is only ancillary to the main purpose of controlling the vorticity and shear influence in the thread during spinning.

BRIEF SUMMARY OF THE INVENTION

In summary, the most amazing aspect of the aforementioned study has been the discovery that a spinning pitch has a "spin reversal" in the carrot portion of the thread as the pitch necks down into a fiber after leaving the spinnerette. This "spin reversal" during drawdown of the pitch creates a reversed shear and/or vorticity in the spinning material that influences the texturing of the fiber. This reversal causes a disruption of the texture such that the material tends to become randomized.

While it may have been known for some time that the texture of the spinning pitch is significant in producing high strength fibers, no one, to the best of our knowledge and belief, was ever sure which texture was best, or was able to consistently achieve high strength textures in a continuous pitch-based carbon fiber.

The discovery that the spinning thread undergoes a "spin reversal" during drawdown is extremely important. This discovery makes possible the means by which the spin process can be controlled and/or optimized.

The magnitude, direction and rate at which shear and vorticity takes place in the spinning fiber can now be controlled, so that a fiber can be consistently produced with an ordered texture, skewed alignment and consequently with optimized mechanical properties.

By controlling at least one or more of the spinning parameters such as viscosity and temperature effecting either the magnitude, direction and/or rate of shear and vorticity, continuous fibers can be produced having oriented textures, such as onion-skin, radial or a hybrid of onion-skin and radial and further having graphite crystallites arranged in undulating ribbons along the fiber axis.

The ultimate object of the invention pertains to the fabrication of high strength, continuous, pitchbased, carbon fibers. A fiber with superior mechanical properties can be produced by controlling the magnitude and/or the rate of change of shear at the spinning reversal, and the vorticity before and after the reversal point. This is so, because the vorticity in the spinning thread influences the texture of the fiber by providing a "maintaining" force. Thus, if the rate or magnitude of the shear and vorticity can be controlled, a high strength fiber can be achieved.

The shear and vorticity in the carrot can be controlled during spinning by controlling at least one of the following spinning parameters, such as: (a) the viscosity of the pre-spun pitch; (b) the temperature of the spinning pitch; (c) the throughput of the spinning pitch; (d) the slope of viscosity versus temperature of the pitch; and (e) the size and shape of the spinnerette capillaries.

The control of these parameters will result in the production of a continuous, pitch-based carbon fiber having a substantially ordered orientation or uniform pattern of graphite crystallites. In other words, the fiber will be substantially free of randomly oriented molecules and will have undulating ribbons throughout its longitudinal axis. The ordering of the crystallites will also consequently result in a fiber having a substantially ordered or uniform texture over a substantial portion of its cross-section. The ordered texture can take several forms, such as: onion-skin, radial or a hybrid of onion-skin and radial. The carbon fibers fabricated in accordance with this invention will have ultimate tensile strengths of at least 325 Ksi at a young's modulus of at least approximately 30 million psi. The pitch precursor yielding such high strength fibers should have a minimum viscosity of at least 2300 poises at spin reversal.

It is an object of this invention to provide an improved continuous pitch-based carbon fiber, and a method of making same;

It is another object of the invention to provide a continuous, pitch-based, carbon fiber having superior mechanical properties;

It is a further object of this invention to provide a continuous, pitch-based, carbon fiber having a substantially uniform and/or ordered texture over a substantial portion of its cross-section;

It is yet another object of the invention to provide a continuous, pitch-based carbon fiber which is substantially free of randomly oriented molecules, texture, or structure;

It is yet a further object of the invention to provide a continuous, pitch-based carbon fiber having undulating ribbons of graphite crystallites along its longitudinal axis; and It is still another object of this invention to provide high strength, pitch-based carbon fibers by an improved spinning process.

These and other objects of the invention will become more apparent and will be better understood with reference to the following detailed description considered in conjunction with the accompanying drawings.

BRIEF DESCRIPTION OF THE DRAWINGS

FIG. 1 is a frontal schematic view of a molten pitch leaving a capillary of a spinnerette during spinning and drawdown;

FIG. 1*a* is a schematic representation of the forces acting to form a radial texture in the top half of the "carrot" (before spin reversal) shown in FIG. 1; FIGS. 2*a* through 2*d* illustrate in an enlarged schematic perspective view, the types of textures existing in the cross-sections of continuously spun pitch-based carbon fibers;

DETAILED DESCRIPTION OF THE INVENTION

Generally speaking, the invention features an improved continuous pitch-based carbon fiber, which has a substantially ordered texture, undulating ribbon alignment and superior mechanical properties.

The improved fiber results from controlling shear and vorticity in the spinning process.

A mathematical model describing the phenomenon occurring in a fiber threadline as it is being drawn from a spinnerette onto a winder was developed. The model not only described the rate of diameter reduction and the decrease in threadline temperature as a function of distance from the spinnerette face, but it also calculated the normal stresses, shear stresses, radial and axial fluid velocities, threadline tension and vorticity. The data generated by this model was used to assess the influence of different spinning parameters on fiber textures (radial, random, onion-skin, or hybrid) axial alignment of the fibrils and mechanical properties. The magnitude, direction, and rate of change of the shear stresses and vorticities correlate very well with the properties, alignments and textures observed in the fibers.

Figure 3A:
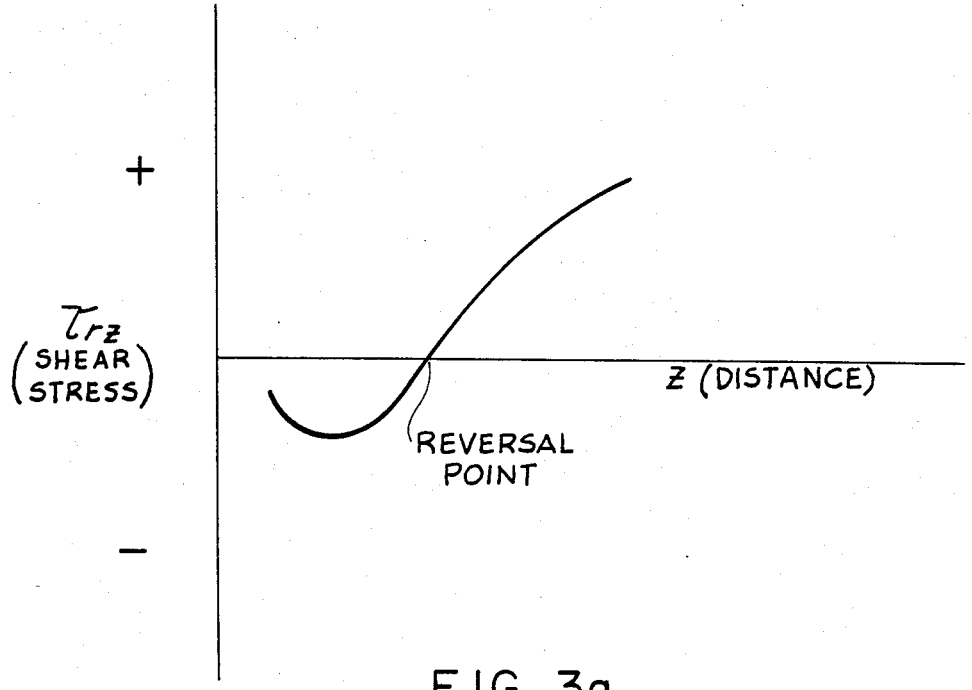
FIG. 3*a* is a graphical representation of the shear stress with respect to distance along the thread in the spinning "carrot" of the fiber shown in FIG. 2.
Figure 3B:
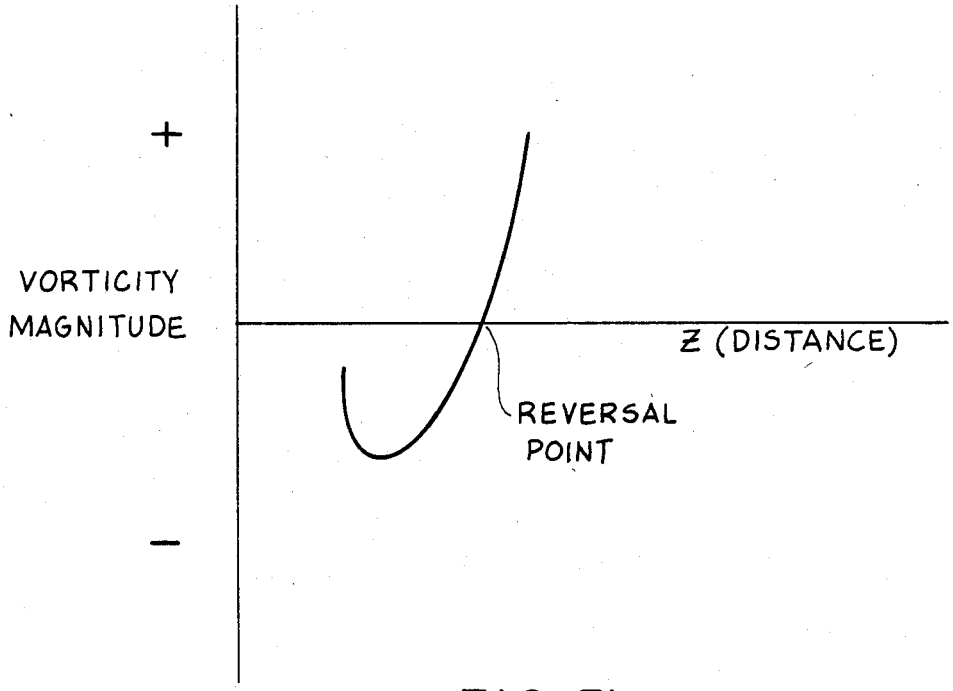
FIG. 3*b* is a graphical representation of the vorticity with respect to distance along the thread in the spinning "carrot" of the fiber shown in FIG. 2.

It has been discovered that the shear stress and vorticity generated during drawdown of the fiber from the spinnerette initially acts in one direction and then reverses itself part way through the drawing process, as graphically represented in FIGS. 3*a* and 3*b*, respectively. This temporary loss of vorticity tends to disrupt the cross-sectional textural order in the fiber, and hence, results in lower mechanical properties. If the viscosity of the carrot below the spin reversal is low, the radial textures will reform when the vorticity returns.

Referring now to FIG. 1, a fiber thread 10 is shown as it is being spun and drawn down from a capillary 11 of a spinnerette 12. The thread 10 initially forms a carrot 13 as it initially comes from the spinnerette 12, and then necks down into a long fiber strand 14.

It has been discovered, that after a given distance along the axis of drawdown "Z", a "spin reversal" takes place in carrot 13. Vortices 16 below the reversal point 17 now spin in an opposite direction to vortices 15 above the reversal point 17.

The reversal in shear and vorticity can cause a temporary dislocation in the material, such that the texture and mechanical properties of the fiber can be severely effected if the viscosity is too low.

Referring to FIG. 1*a*, a schematic of the forces acting upon the top half of carrot 13 are shown. The fluid velocity labelled $V_R$ result from the counterbored shape of the spinerette capillary 12, and act inwardly along the radial axis "R" to influence the structuring of the fibrils of the carrot to form a radial pattern.

If the capillary 12 was a straight bore, it is conceivable that an onion-skin pattern in the carrot 13 would develop instead of the radial pattern.

The reversal in spin can change the pattern developed in the upper portion of the carrot 13 over certain ranges of viscosity of the pitch.

In order to obtain a strong fiber, it was determined that shear stress and vorticity should be controlled. Various spining parameters were investigated with the object of controlling the shear and vorticity in the fiber.

Referring to FIGS. 2*a* through 2*d*, several different textures in the fiber 10 of FIG. 1 are possible depending upon the spinning conditions and rheology of the pitch precursor.

FIG. 2*a* shows a schematic perspective view of a typical fiber 10*a*. The cross-section 18 of the fiber 10*a* depicts a "random" texture for the fibrils 19 of the material, i.e. these fibrils 19 are arranged throughout the fiber 10*a* in a disordered array. This type of texture is typical of prior art fibers. An examination of spun pitch-based carbon fibers under a scanning electron microscope readily reveals that a wide variety of textures can exist within the cross-section of the fibers.

The phrase "texture" of the fiber as defined herein, shall mean "the arrangement of the fibrils 19 across the cross-section of the thread of the fiber". The stacking of fibrils 19 across the fiber diameter can take on a variety of patterns. The "radial" texture 20 is characterized by the basal plane radiating out from the center of the fiber like the spokes of a wheel, as shown in the fiber 10*b* of FIG. 2*b*. The "onion-skin" texture 21, on the other hand, has the basal plane "wrapping around" the center of the fiber like a scroll, as shown in the fiber 10*c* of FIG. 2*c*. The "random" texture 18 of FIG. 2*a* is characterized by the basal plane buckling and meandering across the fiber diameter in a random fashion. The fibrils 19 of the "radial" and "onion-skin" textures of FIGS. 2*b* and 2*c*, respectively tend toward parallel alignment with the fiber axis.

Still another texture which may be created within the fiber is the "hybrid", such as that shown in fiber 10*d* of FIG. 2*d*.

Typically a "hybrid" texture will exhibit a radial core 20 with increasingly disordered regions near the outer surfaces of the fiber. This usually gives the fiber the appearance of having a "collar" around the outside. Occasionally, this collar takes on a distinct "onion-skin" texture 21 in regions where the folded basal planes become aligned parallel to the outer surface of the fiber.

The factors controlling the formation of a given texture in a pitch-based fiber are now for the first time clearly understood. Our studies indicate that the influence of texture on fiber properties is directly related. These textures have influence on fiber properties because the levels of residual stress within fibers of different textures are markedly different. Etching studies on carbon fiber have shown that random textures apparently have areas of high localized residual stress wherever large folds occur in the basal plane. Radial and onion skin textures seem to have much less of that type of residual stress. Fibers with radial textures do, however, have high circumferential tensile stresses which may cause these types of fibers to split during carbonization.

The final texture of the carbon fiber is developed during the spinning process. The orientation of the liquid crystals (fibrils) in the pitch (and hence that of the subsequent graphite crystallites) is determined by the fluid velocity gradients and stress field encountered by the pitch as it is flowing through the spinnerette capillary, and as it is being drawn down to its final diameter.

Tests were conducted for two pitch precursors, Nos. SP 479 and SP 480, wherein various spin parameters were varied in accordance with the invention, and the textures and strengths of the resulting carbon fibers were noted. The precursors designated SP 479 and SP 480 were obtained by the following process:

These precursors were extracted from a heat soaked Ashland 240 pitch using the process in U.S. Pat Nos. 4,277,324 and 4,277,325. The extraction solvent was an 85/15 mixture of toluene and heptane. The extracted pitch was washed with heptane and dried.

The results of the aforementioned tests are tabulated below in Table No. 1.

TABLE 1

Figure 4A:
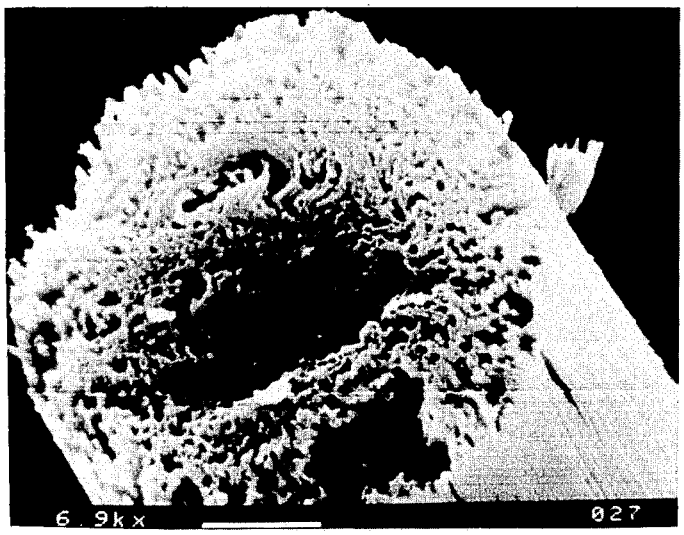
FIGS. 4*a* through 4*e* are enlarged views that illustrate actual textures obtained using the process of this invention.
Figure 4B:
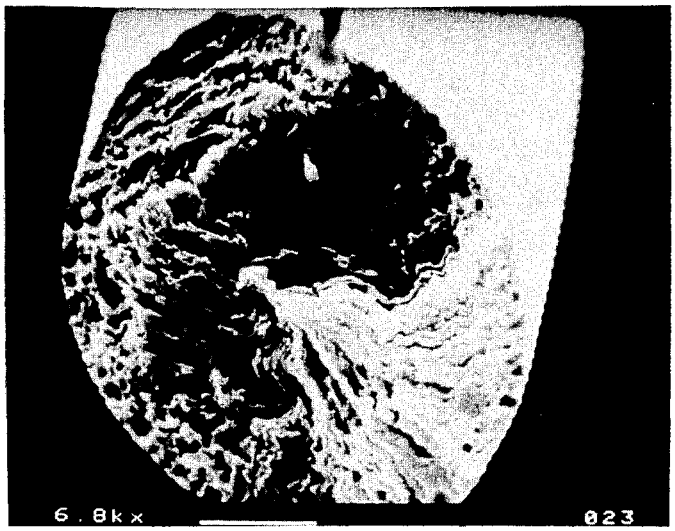
Figure 4C:
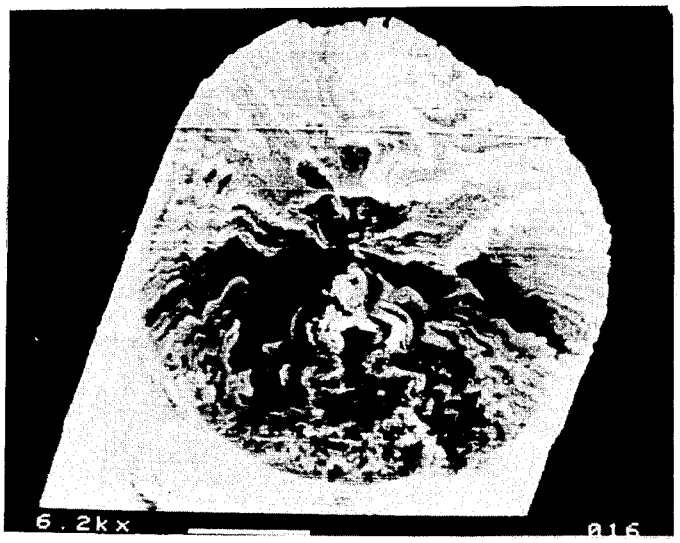
Figure 4D:
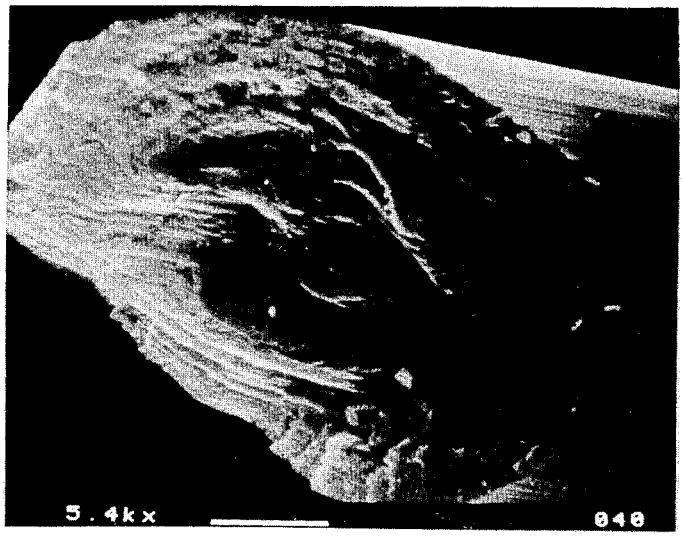
Figure 4E:
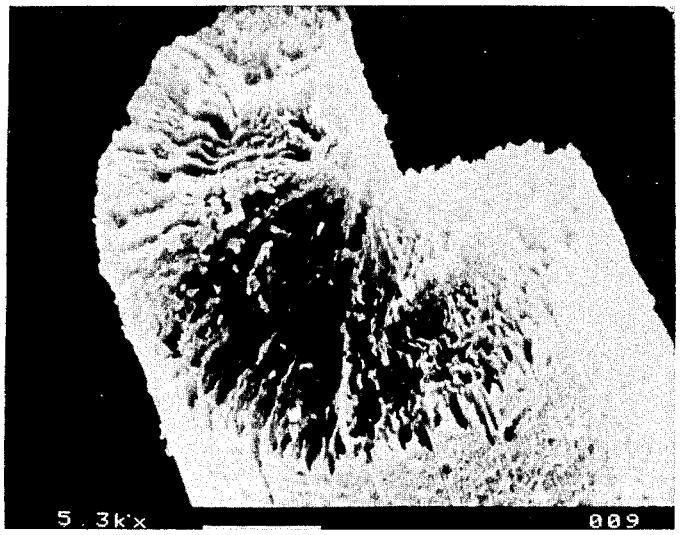

| Test No. | Precursor No. | Capillary Diameter | Flow Rate gpm per 100 holes | Spin Temp. °C. | Spin Viscosity Poise | Winder RPM | Texture | Strength (KSI) |
|---|---|---|---|---|---|---|---|---|
| 1 | SP480 | 150 | 4 | 360 | 800 | 600 | Random | 225 |
| 2 | SP480 | 150 | 7 | 360 | 800 | 950 | Random | 258 |
| 3 | SP480 | 150 | 8 | 360 | 800 | 1075 | Random | — |
| 4 | SP480 | 150 | 9 (FIG. 4a) | 360 | 800 | 1250 | Random | 243 |
| 5 | SP480 | 200 | 4 (FIG. 4b) | 358 | 940 | 600 | Hybrid | 301 |
| 6 | SP480 | 200 | 7 | 356 | 1150 | 950 | Hybrid | 257 |
| 7 | SP480 | 200 | 8 (FIG. 4c) | 353 | 1550 | 1075 | Radial/ some random | 339 |
| 8 | SP480 | 200 | 9 | 355 | 1300 | 1250 | Radial/ some random | 378 |
| 9 | SP479 | 250 | 7 (FIG. 4d) | 351 | 1300 | 950 | Radial/onion some random | 326 |
| 10 | SP479 | 250 | 8 (FIG. 4e) | 348 | 1650 | 1075 | Radial/ some random | 381 |
| 11 | SP479 | 250 | 9 | 349 | 1530 | 1250 | Radial/ random | 333 |

The textures across the width of the fibers for test Nos. 4, 5, 7, 9 and 10 are respectively shown in FIGS. 4*a* through 4*e*.

Most significant about the above data is the fact that fiber strengths and uniformity in texture of the fibers tended to increase with the increase in the spin viscosities of the precursor material.

Also it will be noted that fiber strengths tended to increase with: (1) a decrease in the spin temperature; and (2) increase in throughput (increase in flow rate and capillary diameter).

Tests were also conducted with a pitch precursor No. B-003 prepared in similar fashion to precursors SP 479 and 480, wherein the only parameter varied was viscosity of the pitch at the spin reversal point. The test results are tabulated in Table 2 below:

TABLE 2

| Precursor Designation | Viscosity at Spin Reversal Point (Poises) | Strength (KSI) | E (Young's Modulus) (MSI) | Texture |
|---|---|---|---|---|
| B-003 | 429 | 175 | 32.2 | Radial |
| B-003 | 479 | 157 | 32.1 | Radial |
| B-003 | 746 | 249 | 31.6 | Radial |

TABLE 2-continued

| Precursor Designation | Viscosity at Spin Reversal Point (Poises) | Strength (KSI) | E (Young's Modulus) (MSI) | Texture | |
|---|---|---|---|---|---|
| B-003 | 834 | 284 | 29.4 | Radial | Predominantly Radial |
| B-003 | 933 | 338 | 28.3 | Radial | |
| B-003 | 1044 | 322 | 29.4 | Radial | (Zone 2) |
| B-003 | 1466 | 146 | 32.7 | Radial, Onion | |
| B-003 | 1466 | 264 | 32.1 | Radial | |
| B-003 | 1466 | 400 | 29.3 | Random, Radial | |
| B-003 | 1842 | 285 | 30.5 | Radial | — |
| B-003 | 1842 | 341 | 28.1 | Onion | |
| 480 | 1932 | 258 | — | Random | |
| 480 | 1979 | 243 | — | Random | Predominantly Random and Hybrids |
| 480 | 2032 | 225 | — | Random | |
| B-003 | 2065 | 309 | 30.7 | Hybrid | |
| B-003 | 2317 | 398 | 30.1 | Radial | (Zone 3) |
| B-003 | 2317 | 294 | 28.5 | Random | |
| B-003 | 2317 | 389 | 29.2 | Radial, Hybrid | — |
| B-003 | 2600 | 356 | 30.9 | Radial, Random | |
| 480 | 2776 | 301 | — | Hybrid | |
| B-003 | 3278 | 422 | — | Radial, Hybrid | |
| 480 | 3364 | 257 | — | Hybrid | |
| 480 | 3763 | 378 | — | Radial, Random | |
| 479 | 4013 | 326 | — | Radial, Onion, Random | |
| B-003 | 4139 | 263 | 30.8 | Random | Predominantly Radial |
| 480 | 4681 | 339 | — | Radial, Some Random | |
| 479 | 4780 | 333 | — | Radial, Random | (Zone 4) |
| 479 | 5214 | 381 | — | Radial, Some Random | |

From the above results, it was noted that the texture of the fiber changed with a change in viscosity. It is surmised that there are approximately four zones for the spun precursor. A first zone, which was outside of the viscosity range tabulated above will result in a random texture, as reported in the literature. Most present day spinning techniques are attempting to obtain random textures in fibers derived from precursors having viscosities less than 200 poises. Radially textured fibers of a second zone are obtained with precursors having carrot viscosities in a range of approximately 429 to 1,842 poises.

A third zone of randomly textured fibers is obtained from precursors having carrot viscosities in the range of approximately 1,932 to 2,317 poises.

A fourth zone featuring radially textured fibers was derived from a pitch precursor having carrot viscosities approximately above 2,317 poises at spin temperature.

It will be noted from the above tabulated results that the average fiber strength was highest for the radially textured fibers of zone 4.

The type of alignment of the graphite crystallites along the longitudinal axis of the fiber is believed to be the factor which most explains the difference between the average tensile strengths of the different zones. For example, the radially textured fiber of zone 2 features graphite crystallites which form parallel threads 25 with the axis z—z of the fiber 10', as shown in FIG. 5*a*.

By contrast, the radially textured fiber of zone 4 features graphite crystallites that form threads 27 that are skewed with respect to the fiber axis z—z of fiber 10'', shown in FIG. 45*b*. These skewed threads 27 take the form of undulating ribbons.

Figure 5A:
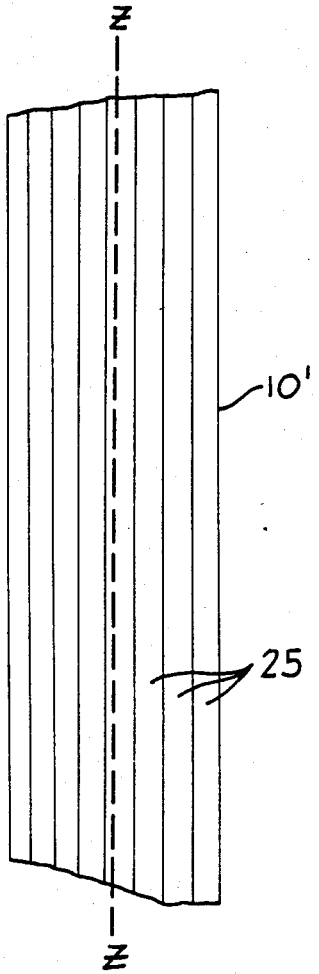
FIG. 5*a* is a schematic enlarged representation of the graphite crystallites aligned parallel with the thread axis "z" of the fiber of FIG. 1.

It is believed, that the more parallel threads as those shown in FIG. 5*a*, do not impart high strength to the fiber because of their suseptibility to internal defects.

Figure 5B:
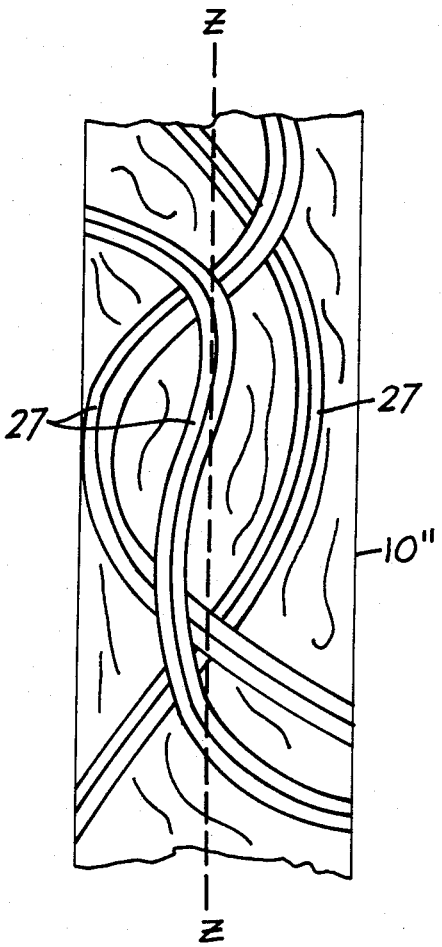
FIG. 5*b* is a schematic enlarged representation of the graphite crystallites aligned with the thread axis "z" of the fiber of FIG. 1 in undulating ribbons.

No matter what the theory regarding the apparent weaknesses of these fibers 10', it is enough to be aware that the undulating ribbons 27 and skewed alignment shown in FIG. 5*b* is the preferred orientation of the graphite crystallites. Such orientation seems to be characteristic of the fibers produced in zone 4 of Table 2, and as such, the parameters such as viscosity that inhibit the straightening of these ribbons is of most interest in accordance with this invention.

It is believed that the higher viscosities of the pitch precursors in zone 4 prevent disruption of the texture when the vortex reverses and "no maintaining" force is present. The radial texture achieved by the radial velocities $V_R$ in the upper portion 13 of carrot 10 in FIG. 1 is not substantially altered. In addition, it is further believed that the higher viscosity helps to freeze in a less parallel alignment of the fibrils 19, as depicted in FIG. 2*b*. It is, therefore, concluded that the fibrils remain twisted and skewed with respect to axis z—z, eventually forming the undulating ribbons 27, as shown in FIG. 5*b*.

The invention has discovered that parameters such as spin viscosity and spinning temperature can control the shear and vorticity effecting the texture and alignment of the graphite crystallites in a spun fiber.

The invention has also discovered that the texture and alignment characteristics are directly related to the ultimate mechanical properties of the fiber.

As such, the objects of the disclosure have been fulfilled by the foregoing exposition, wherefore it is desired to protect the invention by these Letters Patent as presented by the following appended claims.

What is claimed is:

1. A method of spinning a pitch precursor feed material to produce a continuous pitch-base carbon fiber having a substantially ordered graphite crystallite orientation and a longitudinal alignment comprising undulating ribbons, which comprises spinning a mesophase pitch precursor feed material through open spinnerette capillaries, internally free of porous bodies, under such conditions that a fiber carrot formed during said spinning will have a minimum maintained viscosity of at least 2300 poises at spin reversal to produce as-spun carbon fibers having said ordered crystallite orientation and said longitudinal alignment.

2. The method of claim 1 wherein said minimum viscosity at spin reversal is maintained by decreasing the spinning temperature.

3. The method of claim 1 wherein said minimum viscosity at spin reversal is maintained by increasing the viscosity of prespun pitch feed material.

4. The method of claim 1 wherein said minimum viscosity at spin reversal is maintained by increasing the flow rate of the precursor feed material through said spinnerette capillaries and by increasing the diameters of said spinnerette capillaries.

5. A method of spinning a pitch precursor feed material to produce a continuous pitch-base carbon fiber having a substantially onion skin textured cross-section and a longitudinal alignment comprising undulating ribbons, which comprises spinning a mesophase pitch precursor feed material through open spinnerette capillaries, internally free of porous bodies, under such conditions that a fiber carrot formed during said spinning will have a minimum maintained viscosity of at least 2300 poises at spin reversal to produce as-spun carbon fibers having said onion skin textured cross-section and said longitudinal alignment.

6. The method of claim 5 wherein said minimum viscosity at spin reversal is maintained by decreasing the spinning temperature.

7. The method of claim 5 wherein said minimum viscosity at spin reversal is maintained by increasing the viscosity of the pre-spun pitch feed material.

8. The method of claim 5 wherein said minimum viscosity at spin reversal is maintained by increasing the flow rate of the precursor feed material through spinnerette capillaries and by increasing the diameters of said spinnerette capillaries.

9. A method of spinning a pitch precursor feed material to produce a continuous pitch-base carbon fiber having a substantially radial textured cross-section and a longitudinal alignment comprising undulating ribbons, which comprises spinning a mesophase pitch precursor feed material through open spinnerette capillaries, internally free of porous bodies, under such conditions that a fiber carrot formed during said spinning will have a minimum maintained viscosity of at least 2300 poises at spin reversal to produce as-spun carbon fibers having said radial textured cross-section and said longitudinal alignment.

10. The method of claim 9 wherein said minimum viscosity at spin reversal is maintained by decreasing the spinning temperature.

11. The method of claim 9 wherein said minimum viscosity at spin reversal is maintained by increasing the viscosity of pre-spun pitch feed material.

12. The method of claim 9 wherein said minimum viscosity at spin reversal is maintained by increasing the flow rate of the precursor feed material through spinnerette capillaries and by increasing the diameters of said spinnerette capillaries.

13. A method of spinning a pitch precursor feed material to produce a continuous pitch-base carbon fibers having a substantially ordered graphite crystallite orientation and a longitudinal alignment comprising undulating ribbons, which comprises spinning a mesophase pitch precursor feed material through open spinnerette capillaries, internally free of porous bodies, under such conditions that a fiber carrot formed during said spinning will have a minimum maintained viscosity of at least 2300 poises at spin reversal to produce as-spun carbon fibers having said ordered crystallite orientation and said longitudinal alignment.

14. The method of claim 13 wherein said minimum viscosity at spin reversal is maintained by decreasing the spinning temperature.

15. The method of claim 13 wherein said minimum viscosity at spin reversal is maintained by increasing the viscosity of pre-spun pitch feed material.

16. The method of claim 13 wherein said minimum viscosity at spin reversal is maintained by increasing the flow rate of the precursor feed material through spinnerette capillaries and by increasing the diameters of said spinnerette capillaries.

* * * * *